US010214853B2

(12) United States Patent
Matsumoto

(10) Patent No.: US 10,214,853 B2
(45) Date of Patent: Feb. 26, 2019

(54) TEXTILE PRINTING PAPER FOR USE IN PAPER PRINTING METHOD

(71) Applicant: MITSUBISHI PAPER MILLS LIMITED, Sumida-ku, Tokyo (JP)

(72) Inventor: Shinichiro Matsumoto, Sumida-ku (JP)

(73) Assignee: MITSUBISHI PAPER MILLS LIMITED, Tokyo (JP)

( * ) Notice: Subject to any disclaimer, the term of this patent is extended or adjusted under 35 U.S.C. 154(b) by 0 days.

(21) Appl. No.: 15/545,783

(22) PCT Filed: Jan. 27, 2016

(86) PCT No.: PCT/JP2016/052317

§ 371 (c)(1),
(2) Date: Jul. 24, 2017

(87) PCT Pub. No.: WO2016/125651

PCT Pub. Date: Aug. 11, 2016

(65) Prior Publication Data

US 2017/0350070 A1 Dec. 7, 2017

(30) Foreign Application Priority Data

Feb. 5, 2015 (JP) ..... 2015-020999

(51) Int. Cl.

| | |
|---|---|
| ***D06P 5/24*** | (2006.01) |
| ***D21H 19/72*** | (2006.01) |
| ***D21H 27/00*** | (2006.01) |
| ***B41M 1/26*** | (2006.01) |
| ***B41M 1/38*** | (2006.01) |
| ***B41M 3/12*** | (2006.01) |
| ***D06P 5/30*** | (2006.01) |
| ***D21H 19/28*** | (2006.01) |
| ***D21H 21/14*** | (2006.01) |
| *B41M 5/025* | (2006.01) |
| *B41M 5/035* | (2006.01) |
| *B41M 5/52* | (2006.01) |

(52) U.S. Cl.

CPC ..... *D06P 5/003* (2013.01); *B41M 1/26* (2013.01); *B41M 1/38* (2013.01); *B41M 3/12* (2013.01); *D06P 5/30* (2013.01); *D21H 19/28* (2013.01); *D21H 19/72* (2013.01); *D21H 21/14* (2013.01); *D21H 27/00* (2013.01); *B41M 5/0256* (2013.01); *B41M 5/035* (2013.01); *B41M 5/5272* (2013.01)

(58) Field of Classification Search

CPC ..... D21H 19/72; D21H 19/28; D21H 21/14; D06P 5/003

See application file for complete search history.

(56) References Cited

U.S. PATENT DOCUMENTS

| | | | | |
|---|---|---|---|---|
| 6,805,046 | B1 | 10/2004 | Rasmussen | |
| 2003/0203293 | A1* | 10/2003 | Suzuki | B41M 5/385 430/14 |

FOREIGN PATENT DOCUMENTS

| | | | | |
|---|---|---|---|---|
| CN | 102767120 | | 11/2012 | |
| CN | 102828439 | | 12/2012 | |
| EP | 2 500 464 | | 9/2012 | |
| JP | 2002-523271 | | 7/2002 | |
| JP | 2003-073985 | | 3/2003 | |
| JP | 2008261068 | A * | 10/2008 | D21H 19/72 |
| JP | 2010-110973 | | 5/2010 | |
| JP | 4778124 | | 7/2011 | |
| JP | 2013-096033 | | 5/2013 | |
| JP | 2013-209761 | | 10/2013 | |
| JP | 5778366 | | 9/2015 | |
| WO | 2015/093276 | | 6/2015 | |

OTHER PUBLICATIONS

International Standard ISO535, Paper and board—Determination of water absorptiveness—Cobb method, (1991) 1-4, Table 1.

Japan Technical Association of the Pulp and Paper Industry, Kami Pulp Seizo Gijutsu Series 9 Kami Pulp no Shiken Hoho (1995) 136, 137, 166 and 167.

JIS P 8140:1998, Paper and board—Determination of water absorptiveness—Cobb Method (ISO 535:1991).

* cited by examiner

*Primary Examiner* — Betelhem Shewareged

(74) *Attorney, Agent, or Firm* — Venable LLP

(57) ABSTRACT

Provided is a textile printing paper for use in a paper printing method, the textile printing paper being excellent in color development on a printing substrate, transferred unevenness suppressing property and strike-through resistance while satisfying the requirements for adhesiveness of a printed paper to a printing substrate. The textile printing paper comprises a base paper and a glue layer on a surface of the base paper, the base paper having a sizing degree of 10 g/m$^2$ to 40 g/m$^2$ as measured according to JIS P 8140:1998.

1 Claim, No Drawings

TEXTILE PRINTING PAPER FOR USE IN PAPER PRINTING METHOD

This application is a national phase of PCT Application No. PCT/JP2016/052317 filed Jan. 27, 2016, which in turn claims benefit of Japanese Patent Application No. 2015-020999 filed Feb. 5, 2015.

TECHNICAL FIELD

The present invention relates to a textile printing paper for use in transfer printing on a printing substrate such as textile and leather materials. In particular, the present invention relates to a textile printing paper suitable for use in a paper printing method.

BACKGROUND ART

One of the methods for drawing a design fastly and delicately on textile and leather materials etc. with a dye is a printing method. The printing method is roughly classified into a method involving platemaking and a method not involving platemaking.

As examples of the printing method involving platemaking, screen printing, roller printing, rotary screen printing, gravure printing and other printing methods using these printing techniques are known, and have been industrially applied. However, in the printing method involving platemaking, the number of colors that can be used is limited for the reason of platemaking. Particularly, in a printing method involving platemaking based on the RGB tricolor separation, although multiple colors can be expressed, there are problems typified by the following (a) to (d).

(a) It is difficult to adjust the hues and densities of the RGB tricolor components.

(b) The reproducibility of print processing results is poor due to multi-layered printing.

(c) Platemaking is costly for small lot production.

(d) It is necessary to prepare color pastes in excess amounts that are more than actually necessary for print processing.

A solution to the above-described problems is a printing method not involving platemaking. In this printing method, a design is printed on a printing substrate using computer-based image processing and formation technologies etc., for example, by ink jet printing with water-based dye inks. The printing method not involving platemaking is classified into a direct printing method, which involves printing a design directly on a printing substrate, and a transfer printing method, which involves printing a design on a paper called a textile printing paper or a transfer paper, followed by transferring the design printed on the paper to a printing substrate.

A novel transfer printing method (hereinafter referred to as "paper printing method") is publicly disclosed (see, for example, Patent Literature 1) and this method has the following advantages: a textile printing paper has no need for an expensive release agent or a release layer, the textile printing paper can easily be released, a post-printing water washing step produces little water pollution, and the resolution, fastness and color development of a printed design are excellent. The paper printing method described in Patent Literature 1 comprises a step comprising applying a mixed paste of a water-soluble synthetic binder, a natural glue and an auxiliary agent onto a base paper, drying the base paper to prepare a textile printing paper, and printing a dye ink on the textile printing paper to prepare a printed paper;

a step comprising bringing the printed paper into close contact with a printing substrate and sticking them together under pressure and heat; and a step comprising performing dye fixing treatment in such a state that the printed paper is kept stuck to the printing substrate, and then removing the printed paper.

The textile printing paper used in the paper printing method described in Patent Literature 1 is obtained by applying a mixed paste of a water-soluble synthetic binder, a natural glue and an auxiliary agent onto a base paper and drying the base paper.

CITATION LIST

Patent Literature

Patent Literature 1: Japanese Patent No. 4778124

SUMMARY OF INVENTION

Technical Problem

The textile printing paper for use in the paper printing method is required to have the following qualities (1) to (3).

(1) The blank textile printing paper should serve as a printed paper to transfer an image to a printing substrate and achieve the production of the image with dense colors on a printing substrate to fulfill the demand for image quality. That is, "color developing ability" is required.

(2) The blank textile printing paper should serve as a printed paper to transfer an image to a printing substrate and achieve the production of the image without transferred unevenness on a printing substrate. That is, "transferred unevenness suppressing property" is required.

(3) For efficient dye transfer to a printing substrate, the textile printing paper should have such a degree of dye receptivity that dyes do not penetrate too deeper into the textile printing paper. That is, "strike-through resistance" is required.

"Strike-through" is a phenomenon in which dyes of an image printed on a textile printing paper penetrate deeper into the textile printing paper.

However, in Patent Literature 1, the properties of the base paper of the textile printing paper are not fully discussed, and the textile printing paper does not necessarily satisfy the qualities required for the paper printing method.

An object of the present invention is to provide a textile printing paper for use in a paper printing method, the textile printing paper having the desired qualities, i.e., the above-described color developing ability, transferred unevenness suppressing property and strike-through resistance, while satisfying the requirements for adhesiveness of a printed paper to a printing substrate, the adhesiveness being necessary to achieve good transfer results.

Solution to Problem

The above-described object can be achieved by a textile printing paper for use in a paper printing method involving performing dye fixing treatment in such a state that a printed paper is kept stuck to a printing substrate, the textile printing paper comprising a base paper and a glue layer on a surface of the base paper, the base paper having a sizing degree of 10 g/m$^2$ to 40 g/m$^2$ as measured according to JIS P 8140:

1998 (ISO 535:1991). JIS P 8140:1998 is discussed at paragraph [0074].

That is, the present invention relates to the following.

[1] A textile printing paper for use in a paper printing method involving performing dye fixing treatment in such a state that a printed paper is kept stuck to a printing substrate, the textile printing paper comprising a base paper and a glue layer on a surface of the base paper, the base paper having a sizing degree of 10 g/m$^2$ to 40 g/m$^2$ as measured according to JIS P 8140:1998.

[2] The textile printing paper according to the above [1], wherein the glue layer at least contains one or more water-soluble synthetic binders and a natural glue and wherein at least one of the water-soluble synthetic binders is a water-soluble polyester binder with a glass transition temperature of 51° C. or higher.

Advantageous Effects of Invention

The present invention provides a textile printing paper for use in a paper printing method, the textile printing paper being excellent in color development on a printing substrate, transferred unevenness suppressing property and strike-through resistance while satisfying the requirements for adhesiveness of a printed paper to a printing substrate.

DESCRIPTION OF EMBODIMENTS

Hereinafter, the present invention will be described in detail.

In the present invention, the "textile printing paper" refers to a blank sheet of paper which is for use in a paper printing method and yet to be subjected to printing of an image to be transferred. The "printed paper" refers to a printed sheet of paper resulting from printing of an image to be transferred on the textile printing paper. Hereinafter, a blank sheet of paper used in a paper printing method is referred to as "textile printing paper".

In the present invention, the paper printing method refers to the transfer printing method described in Patent Literature 1. That is, the paper printing method is a transfer printing method comprising a step comprising applying, onto a surface of a base paper, a glue layer coating composition consisting of a water-soluble synthetic binder, a natural glue and an auxiliary agent, and drying the base paper to prepare a textile printing paper;

a step of printing an image on the textile printing paper with a dye ink to prepare a printed paper;

a step comprising bringing the printed paper into close contact with a printing substrate and sticking them together under heat and pressure; and a step comprising performing dye fixing treatment in such a state that the printed paper is kept stuck to the printing substrate, and then removing the printed paper.

In the present invention, the textile printing paper comprises a base paper and a glue layer on a surface of the base paper, and the sizing degree of the base paper is 10 g/m$^2$ to 40 g/m$^2$ as measured based on JIS P 8140:1998. Due to the synergistic effect of the combination of the sizing degree of the base paper specified in the present invention and the glue layer specified in the present invention, the textile printing paper of the present invention is excellent in color development, transferred unevenness suppressing property and strike-through resistance while satisfying the requirements for adhesiveness of a printed paper to a printing substrate.

In the present invention, the base paper is a paper made by blending a chemical pulp such as LBKP (Leaf Bleached Kraft Pulp) and NBKP (Needle Bleached Kraft Pulp), a mechanical pulp such as GP (Groundwood Pulp) PGW (Pressure GroundWood pulp), RMP (Refiner Mechanical Pulp), TMP (ThermoMechanical Pulp), CTMP (ChemiThermoMechanical Pulp), CMP (ChemiMechanical Pulp) and CGP (ChemiGroundwood Pulp), or a recycled pulp such as DIP (Deinked Pulp) with a filler such as precipitated calcium carbonate, ground calcium carbonate, talc, clay and kaolin, and as needed, an additive such as a sizing agent, a fixing agent, a retention aid and a cationizing agent such as a cation resin and a multivalent cation salt to prepare a paper stock, rendering the paper stock acidic, neutral or alkaline, and subjecting the paper stock to a paper formation process.

In the present invention, the paper stock for making the base paper can contain another additive such as a pigment dispersant, a thickener, a glidant, a defoamant, a foam suppressor, a release agent, a foaming agent, a penetrant, a coloring dye, a coloring pigment, a fluorescent brightener, an ultraviolet absorber, an antioxidant, a preservative, an antifungal agent, a water resistant additive, a wet strengthening agent and a dry strengthening agent in such an amount that the additive does not impair the effect of the present invention.

In the present invention, the sizing degree of the base paper of the textile printing paper is 10 g/m$^2$ to 40 g/m$^2$. The sizing degree of the base paper is measured according to JIS P 8140:1998. When an image is transferred to a large number of printing substrates in the paper printing method, the corresponding number of printed papers are needed. In the case where the transfer of an image to a printing substrate is continuously carried out using a rolled printed paper in the paper printing method, the sizing degree of the base paper below the above-described range causes a high rate of defective products with transferred unevenness. The reason is unclear, but seems that, when the sizing degree of the base paper of a textile printing paper is relatively low (i.e. the size fastness of the base paper is relatively high), a dye ink used in printing an image ununiformly penetrates into the textile printing paper and thus transferred unevenness is likely to occur. When the sizing degree of the base paper is above the above-described range, the dye fixing treatment, i.e., the transfer and fixation of the dye ink from the printed paper to a printing substrate, does not successfully proceed, resulting in poor color development. In addition, when the sizing degree of the base paper is above the above-described range, strike-through also occurs. The sizing degree of the base paper is also related to the absorption of a glue layer coating composition during the production process of the textile printing paper. When the sizing degree is less than 10 g/m$^2$, uneven coating may occur at the formation of the glue layer.

The sizing degree in the present invention is determined according to JIS P 8140:1998 "Paper and board—Determination of water absorptiveness—Cobb method". In the measurement of the sizing degree in the present invention, the duration of the contact with water is 30 seconds.

For the determination of the sizing degree of the base paper in the textile printing paper, an exemplary procedure is as follows: the glue layer is removed, for example, scraped off to expose the base paper, and the exposed base paper is subjected to the testing according to JIS P 8140:1998.

The sizing degree is a physical property value conventionally known in the papermaking field, and a base paper having the sizing degree within the range specified in the present invention can be obtained by a conventionally known method. Examples of the method include increasing the beating degree of pulp to reduce the freeness of the pulp, adjusting the type and amount of the sizing agent to be used, and adjusting the amount of the filler to be used. These methods can be used in combination.

The basis weight of the base paper is not particularly limited in the present invention. In view of ease of handling in dye transferring, the basis weight is preferably 10 g/m$^2$ to 100 g/m$^2$, and is more preferably 40 g/m$^2$ to 80 g/m$^2$. The thickness of the textile printing paper is also not particularly limited. In view of ease of handling in dye transferring, the thickness is preferably 0.01 mm to 0.5 mm, and is more preferably 0.05 mm to 0.3 mm.

In the present invention, the textile printing paper has a glue layer on a surface of the base paper. The formation of the glue layer on the surface of the base paper can be achieved by applying a glue layer coating composition onto the base paper and drying the coated surface. The glue layer is present on the base paper, present on and partly penetrating into the base paper, or penetrating into the base paper. The glue layer refers to a layer formed of the components of the glue layer coating composition, and is a clearly defined layer that can be observed by, for example, electron microscopy. The glue layer of the present invention has the function as an ink receiving layer to hold an dye ink to be printed on the textile printing paper; the function as an adhesive layer for strong adhesion of a printed paper to a printing substrate upon the application of heat and pressure on the printed paper in close contact with the printing substrate; and the function as a release layer based on the reduction of the adhesive strength as a result of dye fixing treatment (for example, steaming, humidification or dry heating at high temperatures).

The coating weight of the glue layer coating composition on the surface of the base paper is not particularly limited. In view of the production cost of textile printing papers and the adhesion to printing substrates, the coating weight is preferably 5 g/m$^2$ to 70 g/m$^2$, and is more preferably 15 g/m$^2$ to 30 g/m$^2$ in terms of dry solids content.

The method for the formation of the glue layer on the surface of the base paper in the present invention is not particularly limited. For example, coating and drying to form a glue layer are performed using a coating apparatus and a drying apparatus conventionally known in the paper-making field. Examples of the coating apparatus include a comma coater, a film press coater, an air knife coater, a rod blade coater, a bar coater, a blade coater, a gravure coater, a curtain coater and an extrusion bar coater. Examples of the method for the formation of the glue layer include various types of printing processes, such as lithographic printing, letterpress printing, flexographic printing, gravure printing, screen printing and hotmelt printing. Examples of the drying apparatus include various types of dryers such as hot air dryers such as a linear tunnel dryer, an arch dryer, an air loop dryer and a sine wave air floatation dryer; an infrared heat dryer; and a microwave dryer.

The glue layer having the above-described functions preferably contains a water-soluble synthetic binder and a natural glue.

The water-soluble synthetic binder contained in the glue layer is soluble in water, has a strong ability to form a coat upon heat application, and becomes less adhesive in humid conditions. Examples of the water-soluble synthetic binder used in the present invention mainly include petrochemically synthesized ones that do not impede fixing treatment. In the present invention, the term "water-soluble" means that 1% by mass or more of a solute can be dissolved or dispersed in water at 20° C.

Examples of the water-soluble synthetic binder include a water-soluble polyvinyl alcohol binder, a water-soluble acrylic binder, a water-soluble urethane binder, a water-soluble urethane-modified ether binder, a water-soluble polyethylene oxide binder, a water-soluble polyamide binder, a water-soluble phenol binder, a water-soluble vinyl acetate binder, a water-soluble styrene/acrylic binder, a water-soluble styrene/maleic acid binder, a water-soluble styrene/acrylic/maleic acid binder, a water-soluble polyester binder, a water-soluble polyvinyl acetal binder, a water-soluble polyester urethane binder, a water-soluble polyether urethane binder and a water-soluble hotmelt adhesive. One kind or a combination of two or more kinds selected from the group consisting of these examples can be used as the water-soluble synthetic binder. Among these, preferred is at least one kind of water-soluble synthetic binder selected from the group consisting of a water-soluble polyvinyl alcohol binder, a water-soluble acrylic binder, a water-soluble polyester binder, a water-soluble polyether urethane binder and a water-soluble hotmelt adhesive because these water-soluble synthetic binders are excellent in water solubility and temporary adhesiveness (the property means that the substance adheres upon heat application but becomes less adhesive in humid conditions) and do not impede fixing treatment.

Examples of the water-soluble hotmelt adhesive include an alkali-soluble hotmelt adhesive composed of a maleic acid-based alternating copolymer, a water-sensitive hotmelt adhesive and a polyvinyl alcohol hotmelt adhesive.

At least one of the water-soluble synthetic binders used is preferably a water-soluble polyester binder having a glass transition temperature of 51° C. or higher. The glass transition temperature of the water-soluble polyester binder is preferably from 51° C. to 100° C., and is more preferably from 51° C. to 80° C. This is because t e water-soluble polyester binder having a glass transition temperature of 51° C. or higher can prevent uneven coating at the time of the glue layer formation. The prevention of uneven coating enhances the quality of a printed image on a printing substrate.

The water-soluble polyester binder is a resin that can be obtained by polycondensation of a polycarboxylic acid and a polyol, the total of which accounts for 60% by mass or more of the components of the resin. Examples of the polycarboxylic acid include terephthalic acid, isophthalic acid, phthalic acid, naphthalene dicarboxylic acid, adipic acid, succinic acid, sebacic acid and dodecanedioic acid. Preferably, one or more kinds selected from the group consisting of these examples are used. Examples of the polyol include ethylene glycol, propylene glycol, 1,4-butanediol, 1,6-hexanediol, neopentylglycol, diethylene glycol, dipropylene glycol, cyclohexanedimethanol and bisphenol. Preferably, one or more kinds selected from the group consisting of these examples are used. The water-soluble polyester binder may be copolymerized with a component having a hydrophilic group such as a carboxyl group and a sulfonic group for the enhancement of water solubility. The glass transition temperature of the water-soluble polyester binder can be adjusted by selecting a suitable polycarboxylic acid and a suitable polyol. Alternatively, the water-soluble polyester binder may be copolymerized with another component for the adjustment of the glass transition temperature.

Water-soluble polyester binders are commercially available from Goo Chemical Co., Ltd., Takamatsu Oil & Fat Co., Ltd., Unitika Ltd., etc., and such commercial products can be used in the present invention.

In the present invention, the glass transition temperature can be determined from measurement using a differential scanning calorimeter, for example, "EXSTAR 6000" (trade name, manufactured by Seiko Instruments Inc.), "DSC220C" (trade name, manufactured by Seiko Instruments Inc.), "DSC-7" (trade name, manufactured by PerkinElmer, Inc.), or the like, and is defined as the point of intersection of the baseline and the slope of an endothermic peak.

The natural glue contained in the glue layer is an unprocessed or physically- or chemically-processed naturally-occurring gluing material. The natural glue is hydrophilic and has an adhesive strength that does not increase upon heat application, and therefore can be removed by fixing treatment or dry heating. In addition, the natural glue is highly miscible with a dye ink and can uniformly absorb and hold a dye ink.

Natural glues can be classified into animal-derived ones, plant-derived ones and mineral-derived ones. Examples of the animal-derived glue include gelatin, which is extracted from collagen contained in animal skin and bones. Examples of the plant-derived glue include starch and carboxymethyl cellulose, which is obtained by processing cellulose as a starting material. Examples of the mineral-derived glue include clay, which is extracted from clay minerals. More specific examples of the natural glue include natural gums (e.g., etherified tamarind gum, etherified locust bean gum, etherified guar gum, acacia (gum arabic), etc.); cellulose derivatives (e.g., carboxymethyl cellulose, etherified carboxymethyl cellulose, hydroxyethyl cellulose, etc.); starch derivatives (e.g., starch, glycogen, dextrin, amylose, hyaluronic acid, arrowroot starch, konjac starch, potato starch, etherified starch, esterified starch, etc.); seaweeds (e.g., sodium alginate, agar, etc.); mineral-derived glues (e.g., bentonite, aluminum silicate and its derivatives, oxidized silicon including silica, diatomite, clay, kaolin, acid clay, etc.); and animal-derived glues (e.g., casein, gelatin, egg protein, etc.). One kind or a combination of two or more kinds selected from the group consisting of these examples can be used. Among them, preferred as the natural glue are natural gums; cellulose derivatives such as carboxymethyl cellulose; starch derivatives such as etherified starch; seaweeds such as sodium alginate; mineral-derived glues such as oxidized silicon, aluminum silicate and clay; animal-derived glues; and the like.

The mass ratio of the water-soluble synthetic binder and the natural glue contained in the glue layer in the present invention is preferably in the range of 95:5 to 20:80 in terms of dry solids content. When the mass ratio of the water-soluble synthetic binder and the natural glue is in his range, printed paper can more easily be released from the printing substrate after fixing treatment, the color yield of the dye to be transferred is further enhanced, and transferred unevenness is reduced.

In the present invention, the glue layer of the textile printing paper can contain an auxiliary agent. The auxiliary agent is intended to, for example, optimize the physical properties of the glue layer coating composition and enhance the color yield of the dye to be transferred. Examples of the auxiliary agent include various types of surfactants, thickeners, moisturizers, wetting agents, pH adjusters, alkaline chemicals, color deepening agents, preservatives, antifungal agents, degassing agents, defoamants and reduction inhibitors.

The amount of the auxiliary agent contained in the glue layer is as follows. For example, in the case where an anionic surfactant or the like is added as the auxiliary agent to function as a surface tension depressant or a penetrant, the amount of the auxiliary agent is 0.2 to 5% by mass relative to the dry solids content of the glue layer. In the case where a moisturizer or a wetting agent, such as polyhydric alcohols such as polyethylene glycol, glycerin, thiodiglycol and diethylene glycol, urea, thiourea and dicyandiamide, is added as the auxiliary agent to enhance the adhesiveness of the printed paper to the printing substrate and to enhance the color yield of the dye, the amount of the auxiliary agent is 1 to 15% by mass relative to the dry solids content of the glue layer. In the case where a synthetic acrylic thickener is added as the auxiliary agent to stabilize coating, the amount of the auxiliary agent is 3% by mass or less relative to the dry solids content of the glue layer. In the case where a preservative, an antifungal agent, a defoamant, a degassing agent or a reduction inhibitor is added as the auxiliary agent, the amount of the auxiliary agent is 0.1 to 5% by mass relative to the dry solids content of the glue layer. In the case where an alkaline chemical, such as soda ash, sodium bicarbonate, sodium silicate and sodium acetate, is added as the auxiliary agent on the occasion of using a reactive dye, the amount of the auxiliary agent is 1 to 25% by mass relative to the dry solids content of the glue layer. In the case where a pH adjuster, such as ammonium sulfate and sodium dihydrogenphosphate, is added as the auxiliary agent on the occasion of using a disperse dye or an acid dye, the amount of the auxiliary agent is 0.1 to 3% by mass relative to the dry solids content of the glue layer. When the amount of each auxiliary agent contained in the glue layer is in the above range, preferable results can be obtained.

In the present invention, the printed paper is prepared by printing an image on the glue layer side of the textile printing paper by a conventionally known printing process using a dye ink. The image is made based on a design to be printed. The textile printing paper may have glue layers on both surfaces of the base paper. This embodiment is preferable because such a textile printing paper can be used without any care about the distinction between the back and front sides of the textile printing paper.

Examples of the printing process used in the present invention to print an image on the glue layer side of the textile printing paper include gravure printing, ink jet printing and screen printing. Particularly preferred is ink jet printing in terms of the high resolution of the printed image and the compactness of the apparatus used.

Examples of the dye ink used in the present invention include dye inks conventionally known in dye printing methods, specifically, dye inks containing dyes such as a reactive dye, an acid dye, a metal complex salt dye, a direct dye, a disperse dye and a cationic dye. The dye ink is prepared by dissolving or dispersing a dye as typified above, and if needed, an additive(s) in a solvent for dyes such as water.

The dye ink for inkjet printing used in the paper printing method is prepared by dissolving or dispersing a dye in, for example, a solvent or dispersant for dyes. Examples of the solvent for dyes include water, thiodiglycol, polyethylene glycol, glycerin, ethylene glycol and ε-caprolactam. If needed, the dye ink further contains a drying inhibitor, a surface tension modifier, a viscosity modifier, a pH adjuster, a preservative, an antifungal agent, a chelating agent, a defoamant, a degassing agent and/or the like.

The type of the dye is selected from a reactive dye, a direct dye, an acid dye, a metal complex salt dye, a disperse dye, a cationic dye, etc. according to the type of the printing substrate. In the case where a disperse dye is made into an ink, the disperse dye is preferably finely ground in a mill using zirconia beads of 0.1 mm to 0.3 mm in size so that the average particle diameter of the disperse dye will be about 0.1 μm.

In the present invention, the paper printing method is the method described in JP-4778124, which comprises a step of preparing a textile printing paper, a step of printing an image on the textile printing paper to prepare a printed paper, a step of bringing the printed paper into close contact with a printing substrate, a step of performing dye fixing treatment in such a state that the printed paper is in close contact with the printing substrate, and a step of removing the printed paper from the printing substrate.

In the present invention, the above-mentioned contact step comprises heating and pressurization. After the close contact of the printed paper with the printing substrate, dye fixing treatment is performed while the close contact is maintained. The conditions of the heating and pressurization in the above-mentioned contact step may be the same as those used in conventionally known transfer printing methods. For example, a heating drum or the like is used to bring the printed paper into close contact with a printing substrate and to apply heat and pressure.

In the present invention, the paper printing method involves performing dye fixing treatment in such a state that the printed paper is in close contact with the printing substrate. Examples of the dye fixing treatment include steaming as commonly used in printing using a reactive dye etc., and heating after humid or moist exposure. In the case where the printing substrate is made of polyester fibers or other synthetic fibers, dry heating may be employed. The dye fixing treatment by steaming or heating after humid or moist exposure makes the printed paper releasable. In the case where the printing substrate is made of polyester fibers or other synthetic fibers, the dye fixing treatment by dry heating may also make the printed paper releasable, but preferably, moist exposure is performed after dry heating for easier release of the printed paper.

In the present invention, the conditions of the dye fixing treatment performed in such a state that the printed paper is in close contact with the printing substrate may be the exact same as those of steam fixation of dyes used in conventionally known direct printing methods. For example, steam at 100 to 220° C. is applied from the non-printed side of the printed paper. In the case where the dye is a reactive dye, steaming can be performed at 100 to 105° C. for 5 to 20 minutes as in single-phase steam fixing. In the case where the glue layer contains no alkaline chemicals, the same steaming conditions as used in two-phase steam fixing (for example, cold fixing etc.) can be employed. In the case where the dye is an acid dye, steaming can be performed at 100 to 105° C. for 10 to 30 minutes. Such a moist or humid exposure by steaming makes it easy to release printed paper from the printing substrate. In the case where the dye is a disperse dye, HT steaming (high temperature steaming) at 160 to 220° C. for 1 to 15 minutes or dry heating can be performed. The printed paper subjected to dry heating may become releasable, but preferably, the printed paper is exposed to a small amount of humidity or moisture after dry heating for easier release of the printed paper.

In the present invention, the dye fixing treatment may be performed after or at the same time as the heating and pressurization in the step of bringing the printed paper into close contact with a printing substrate. After the printed paper is brought into close contact with the printing substrate, heating and pressurization and dye fixing treatment are performed, and as a result, the dye in the dye ink printed on the textile printing paper is transferred and bonded to the printing substrate. The dye fixing treatment results in not only the fixation of the dye bonded to the printing substrate, but also the reduction of the adhesive strength between the printed paper and the printing substrate.

After the fixing treatment, the printed paper is released from the printing substrate, and the printing substrate may be subjected to a washing treatment conventionally known in the dye printing field, such as water washing and soaping. For example, in the case of using a disperse dye, the washing procedure is made up of water washing, reduction cleaning and water washing in this order; and in the case of using other dyes, the washing procedure is made up of water washing, soaping and water washing in this order. After water washing, a dyed printing substrate that has a good texture as well as a high-resolution and densely-colored image can be obtained. In the case where the dye is a disperse dye or the printing substrate is made of synthetic fibers such as polyester, even if water washing is not performed, a dyed printing substrate that has a good texture as well as a high-resolution and densely-colored image can be obtained.

In the present invention, the printing substrate is, for example, a textile or leather material, but is not limited thereto. The textile material may be a natural fiber material or a synthetic fiber material. Examples of the natural fiber material include cellulosic fiber materials such as cotton, hemp, lyocell, rayon and acetate; and protein fiber materials such as silk, wool and other animal hairs. Examples of the synthetic fiber material include a polyamide fiber (nylon), vinylon, polyester and polyacrylic. Examples of the leather material include natural leathers derived from cattle, water buffalos, pigs, horses, sheep, goats, kangaroos, deer, leopards, rabbits, foxes and camels; and dry processed leathers obtained by a known tanning process and/or other leather production processes.

In the present invention, the textile or leather material can be produced in the form of a woven fabric, a knit fabric, a non-woven fabric, a leather or the like by using a single yarn, a blended yarn, a combined filament yarn or two different yarns. Moreover, the textile or leather material may be produced in a composite form of these forms. In addition, if needed, the printing substrate may be pretreated with chemicals which affect the color yield of the dye or chemicals which have enhancing effect on the color yield of the dye. For example, in the case where a reactive dye is used, the printing substrate may be pretreated with a pretreatment liquid containing 3 to 15% by mass of an alkaline chemical such as sodium carbonate, potassium carbonate, sodium bicarbonate, sodium silicate, sodium acetate, sodium sesquicarbonate and sodium trichloroacetate; 3 to 25% by mass of urea for the prevention of yellowing at the time of printing, the improvement of print results and the enhancement of color yield; and 0.05 to 1% by mass of a hydrophilic thickener, for example, sodium alginate, as a migration inhibitor. In the case where an acid dye is used, the printing substrate may be pretreated with a pretreatment liquid containing 0.5 to 5% by mass of an ammonium salt of an acid such as ammonium sulfate and ammonium tartrate as a color yield enhancer; and 0.05 to 0.5% by mass of an acid-resistant natural gum as a migration inhibitor. However, in the present invention, pretreatment is usually unnecessary.

EXAMPLES

Hereinafter, the present invention will be illustrated in more detail by examples, but the present invention is not limited thereto. Various alterations and modifications can be made without departing from the technical scope of the present invention. In the following Examples, except as to the value of sizing degree, "part" and "%" represent "part by mass" and "% by mass" in terms of dry solids content or the amount of a substantial component, respectively. The coating weight of a glue layer coating composition is expressed as dry solids content.

Example 1

Preparation of Glue Layer Coating Composition 300 parts of a water-soluble polyester binder (trade name "PLAS COAT RZ-142", glass transition temperature: 34° C., manufactured by Goo Chemical Co., Ltd.), 30 parts of polyvinyl alcohol (trade name "AP-17", manufactured by JAPAN VAN & POVAL CO., LTD.), 120 parts of etherified starch (trade name "Solvitose C-5", manufactured by Avebe), 60 parts of an aluminum silicate derivative (trade name "Enbatex D-23", manufactured by KYOEI KAGAKU Co., LTD.), 55 parts of silicon dioxide (trade name "MIZUKASIL P-78A", manufactured by Mizusawa Industrial Chemicals, Ltd.), 60 parts of dicyandiamide, 210 parts of soda ash, 90 parts of urea, 60 parts of thiourea, 15 parts of a surfactant (trade name "MAC-100S", manufactured by HOKKO CHEMICALS Co., Ltd.) and 930 parts of water were mixed with vigorous stirring using a mixer to prepare a glue layer coating composition.

Preparation of Textile Printing Paper

As the base paper, a high-quality paper having a basis weight of 77 g/m$^2$ and a sizing degree of 25 g/m$^2$ as measured according to JIS P 8140:1998 was used. Onto one surface of this base paper, the above-prepared glue layer coating composition was applied using an air knife coater and then dried to give a textile printing paper. The coating weight of the glue layer coating composition was 20 g/m$^2$.

Preparation of Printed Paper

A test image was printed on the glue layer side of the textile printing paper with an inkjet printer (trade name "ValueJet VJ-1324", manufactured by MUTOH INDUSTRIES, Ltd.) using a reactive dye ink (15% C.I. Reactive Blue 19, 5% polyethylene glycol, 5%, glycerin, 5% ε-caprolactam and 70% ion exchanged water), a reactive dye ink (10% C.I. Reactive Red 226, 5% polyethylene glycol, 5% glycerin, 5% ε-caprolactam and 75% ion exchanged water) and a reactive dye ink (15% C.I. Reactive Yellow 95, 5% polyethylene glycol, 5% glycerin, 5% ε-caprolactam and 70% ion exchanged water), to give a printed paper (rolled printed paper).

Printing

Cotton fabric was used as the printing substrate. The printed paper was brought into close contact with a cotton fabric, and heat and pressure were applied (190° C., 0.5 MPa, 2.5 m/min, on a roller) to allow the printed paper to stick to the cotton fabric. With the printed paper being stuck on the cotton fabric, fixing treatment was performed by steaming at 100° C. for 15 minutes to achieve the transfer of the dye inks to the cotton fabric. After printing was completed, the printed paper was released.

After the release of the printed paper, the cotton fabric was subjected to water washing, soaping and water washing in the usual manner, and then dried to give a dyed printing substrate.

Example 2

The dyed printing substrate of Example 2 was obtained in the same manner as in Example 1 except that a high-quality paper having a basis weight of 77 g/m$^2$ and a sizing degree of 38 g/m$^2$ as measured according to JIS P 8140:1998 was used as the base paper.

Example 3

The dyed printing substrate of Example 3 was obtained in the same manner as in Example 1 except that a high-quality paper having a basis weight of 77 g/m$^2$ and a sizing degree of 12 g/m$^2$ as measured according to JIS P 8140:1998 was used as the base paper.

Example 4

The dyed printing substrate of Example 4 was obtained in the same manner as in Example 1 except that a water-soluble polyester binder (trade name "PESRESIN A-615GE", glass transition temperature: 47° C., manufactured by Takamatsu Oil & Fat Co., Ltd.) was used instead of the water-soluble polyester binder (trade name "PLAS COAT RZ-142", glass transition temperature: 34° C., manufactured by Goo Chemical Co., Ltd.).

Example 5

The dyed printing substrate of Example 5 was obtained in the same manner as in Example 1 except that a water-soluble polyester binder (trade name "PESRESIN A-613D", glass transition temperature; 54° C., manufactured by Takamatsu Oil & Fat Co., Ltd.) was used instead of the water-soluble polyester binder (trade name "PLAS COAT RZ-142", glass transition temperature: 34° C., manufactured by Goo Chemical Co., Ltd.).

Example 6

The dyed printing substrate of Example 6 was obtained in the same manner as in Example 1 except that a water-soluble polyester binder (trade name "Emulsion Elitel KA-5071S", glass transition temperature: 67° C., manufactured by Unitika Ltd.) was used instead of the water-soluble polyester binder (trade name "PLAS COAT RZ-142", glass transition temperature: 34° C., manufactured by Goo Chemical Co., Ltd.).

Example 7

The dyed printing substrate of Example 7 was obtained in the same manner as in Example 1 except that a water-soluble polyester binder (trade name "Emulsion Elitel KZA-6034", glass transition temperature: 72° C., manufactured by Unitika Ltd.) was used instead of the water-soluble polyester binder (trade name "PLAS COAT RZ-142", glass transition temperature: 34° C., manufactured by Goo Chemical Co., Ltd.).

Example 8

The dyed printing substrate of Example 8 was obtained in the same manner as in Example 1 except that a water-soluble polyester binder (trade name "Emulsion Elitel KZA-3556", glass transition temperature: 80° C., manufactured by Unitika Ltd.) was used instead of the water-soluble polyester binder (trade name "PLAS COAT RZ-142", glass transition temperature: 34° C., manufactured by Goo Chemical Co., Ltd.).

Example 9

The dyed printing substrate of Example 9 was obtained in the same manner as in Example 1 except that a water-soluble polyester urethane binder (trade name "HYDRAN AP-20", glass transition temperature: 27° C., manufactured by DIC Corporation) was used instead of the water-soluble polyester binder (trade name "PLAS COAT RZ-142", glass transition temperature: 34° C., manufactured by Goo Chemical Co., Ltd.).

Comparative Example 1

The dyed printing substrate of Comparative Example 1 was obtained in the same manner as in Example 1 except that a high-quality paper having a basis weight of 77 g/m$^2$ and a sizing degree of 42 g/m$^2$ as measured according to JIS P 8140:1998 was used as the base paper.

Comparative Example 2

The dyed printing substrate of Comparative Example 2 was obtained in the same manner as in Example 1 except that a high-quality paper having a basis weight of 77 g/m$^2$ and a sizing degree of 8 g/m$^2$ as measured according to JIS P 8140:1998 was used as the base paper.

In Examples 1 to 9 and Comparative Examples 1 and 2, color development on the dyed printing substrates, transferred unevenness suppressing property, strike-through resistance ad resistance to coating unevenness of the glue layer were evaluated according to the methods described below. The results are shown in Table 1.

TABLE 1

| | Sizing degree of base paper (g/m$^2$) | Color development on dyed printing substrate | Transferred unevenness suppressing property | Strike-through resistance | Resistance to coating unevenness |
|---|---|---|---|---|---|
| Example 1 | 25 | 4.54 | 3 | 3 | 2 |
| Example 2 | 38 | 4.61 | 3 | 3 | 2 |
| Example 3 | 12 | 4.44 | 3 | 3 | 2 |
| Example 4 | 25 | 4.52 | 3 | 3 | 2 |
| Example 5 | 25 | 4.55 | 4 | 3 | 3 |
| Example 6 | 25 | 4.56 | 4 | 3 | 3 |
| Example 7 | 25 | 4.54 | 4 | 3 | 3 |
| Example 8 | 25 | 4.52 | 4 | 3 | 3 |
| Example 9 | 25 | 4.52 | 3 | 3 | 2 |
| Comparative Example 1 | 42 | 4.32 | 3 | 1 | 2 |
| Comparative Example 2 | 8 | 4.48 | 1 | 3 | 1 |

Evaluation of Color Development on Dyed Printing Substrates

The color density of the solid printed area of each of the 3 color inks on the dyed printing substrate was measured using an optical densitometer (trade name "X-rite 530", manufactured by SAKATA INX ENG. CO. LTD.). The values of the measured 3 color densities were summed. In the present invention, when the sum of the values was 4.40 or more, the color development was regarded as excellent.

Evaluation of Transferred Unevenness Suppressing Property

Fifty test images were printed in the same manner as described above using the same reactive dye inks as described above, and the resulting printed paper was rolled up at ordinary temperature. Using this rolled printed paper, 50 dyed printing substrates were produced. The degree of occurrence of transferred unevenness on each dyed printing substrate was visually evaluated based on the following criteria.

A: Transferred unevenness was hardly observed, and the quality of the printed image was good.

B: Transferred unevenness was slightly observed, but the quality of the printed image was practically acceptable.

C: Transferred unevenness was observed, and the quality of the printed image was practically unacceptable.

After the visual evaluation, the number of dyed printing substrates evaluated as A or C was counted, and grading was performed based on the criteria shown below. In the present invention, grade 3 or 4 means that the transferred unevenness suppressing property was excellent.

4: The number of dyed printing substrates evaluated as C was less than 2, and the number of dyed printing substrates evaluated as A was: 30 or more.

3: The number of dyed printing substrates evaluated as C was less than 2, and the number of dyed printing substrates evaluated as A was less than 30.

2: The number of dyed printing substrates evaluated as C was 2 or more and less than 6.

1: The number of dyed printing substrates evaluated as C was 6 or more.

Evaluation of Strike-Through Resistance

The visibility of the printed image from the back side of the printed paper (rolled printed paper) prepared as described above and the quality of the dyed printing substrate produced using the printed paper were visually evaluated based on the criteria shown below. In the present invention, grade 2 or 3 means that the strike-through resistance was excellent.

3: Strike-through was hardly observed, and the quality of the printed image was good.

2: Strike-through was slightly observed, but the quality of the printed image was practically acceptable.

1: Strike-through was observed, and the quality of the printed image was practically unacceptable.

Evaluation of Resistance to Coating Unevenness

While the textile printing paper prepared as described above was being exposed to oblique light, the surface of the glue layer formed by the application of the coating composition was observed. The coating result was visually evaluated based on the criteria shown below. In the present invention, grade 2 or 3 means that uneven coating was successfully prevented.

3: Coating unevenness was hardly observed.

2: Coating unevenness was slightly observed.

1: Coating unevenness was more markedly observed than in the case of grade 2.

As clearly shown in Table 1, in Examples 1 to 9, each of which used a base paper having a sizing degree within the range specified in the present invention, the adhesiveness of the printed paper to the printing substrate was not reduced, color development on the dyed printing substrate was excellent, and transferred unevenness and strike-through were prevented. Meanwhile, such effects were not achieved in Comparative Example 1 or 2, which used a base paper having a sizing degree outside the range specified in the present invention.

In addition, the comparison of Examples 1 to 4 and 9 with Examples 5 to 8 shows that prevention of uneven coating was achieved when at least one of the water-soluble synthetic binders used was a water-soluble polyester binder having a glass transition temperature of 51° C. or higher, and therefore, the use of such a component is considered as more preferable.

INDUSTRIAL APPLICABILITY

The textile printing paper of the present invention is excellent in color development, transferred unevenness suppressing property and strike-through resistance while satisfying the requirements for adhesiveness of a printed paper to a printing substrate. Therefore, the textile printing paper is suitable as a textile printing paper for use in the paper printing method.

Determination of Water Absorptiveness, Cobb Method a) Dry the edge of a cylinder where the test piece will touch, and dry also the surface of a rigid base.

b) Measure the mass of the test piece to the nearest 1 mg, and place it on the rigid base with face to be tested upward. Place the finished edge of the cylinder on the target surface of the test piece, and fix sufficiently with a clamp so as not to leak water between the test piece and cylinder.

c) Pour 100 ml±5 ml of water (when 100 $cm^2$ test area was taken) into the cylinder to make 10 mm water depth. Simultaneously, start a timer. Use new water every time test is carried out.

d) After the timer runs, within the "Time at which excess water is removed" specified in Table 1, pour off the excess water kept in the cylinder taking care not to moisten place other than the area to be tested. Quickly unclamp the cylinder from the test piece, put the test piece on a dried blotting paper previously placed on a flat hard base, with the tested surface upward.

e) Within the "Time at which blotting is carried out" specified in Table 1, place a dried blotting paper on the test piece. Using a metal roller, roll it twice (one recipro-cating motion) without applying any pressure, to eliminate excess water. Immediately after blotting, fold the test piece with the wet side inside, and weigh swiftly its mass to the nearest 1 mg.

TABLE 1

| Recommended time of contact s | Symbol | Times at which water is removed s | Times at which blotting is carried out s |
|---|---|---|---|
| 30 | Cobb30 | 20 ± 1 | 30 ± 1 |
| 60 | Cobb60 | 45 ± 1 | 60 ± 2 |
| 120 | Cobb120 | 105 ± 2 | 120 ± 2 |
| 300 | Cobb300 | 285 ± 2 | 300 ± 2 |
| 1800 | Cobb1800 | 1755 to 1815 | 15 ± 2 after removing excess water |

f) Number of test trials: Five times or more shall be carried out respectively on surface and back surface of the test piece.

Calculation: The calculation of absorptiveness shall be as follows:

$A=(m_2-m_1)F$ where A ($g/m^2$) is absorptiveness (Cobb value), $m_1$ is dry mass (g) of test piece, $m_2$ is wet mass (g) of test piece, and F is 10000/S.

The invention claimed is:

1. A textile printing paper for use in a paper printing method involving performing dye fixing treatment in such a state that a printed paper is kept stuck to a printing substrate, the textile printing paper comprising a base paper and a glue layer on a surface of the base paper, wherein the glue layer functions as an ink receiver, as an adhesive layer for adhering the printed paper to the printing substrate, and as a release layer, the base paper has a sizing degree of 10 to 40 $g/m^2$ as measured according to JIS P 8140:1998, and the glue layer comprises at least one water-soluble synthetic binder and a natural glue, and at least one of the water-soluble synthetic binders is a water-soluble polyester binder with a glass transition temperature of 51° C. or higher.

* * * * *